US010118759B2

(12) United States Patent
Vanparys et al.

(10) Patent No.: US 10,118,759 B2
(45) Date of Patent: Nov. 6, 2018

(54) SILO, KIT AND METHOD FOR CONSTRUCTING A SILO

(71) Applicant: SCE, Lichtervelde (BE)

(72) Inventors: Francky Vanparys, Lichtervelde (BE); Andy Vanparys, Lichtervelde (BE)

(73) Assignee: SCE, Lichtervelde (BE)

( * ) Notice: Subject to any disclaimer, the term of this patent is extended or adjusted under 35 U.S.C. 154(b) by 0 days.

(21) Appl. No.: 15/520,079

(22) PCT Filed: Oct. 23, 2015

(86) PCT No.: PCT/IB2015/058194

§ 371 (c)(1),
(2) Date: Apr. 19, 2017

(87) PCT Pub. No.: WO2016/063259

PCT Pub. Date: Apr. 28, 2016

(65) Prior Publication Data

US 2017/0305655 A1 Oct. 26, 2017

(30) Foreign Application Priority Data

Oct. 23, 2014 (BE) ..... 2014/0783
Mar. 24, 2015 (DE) ..... 20 2015 101 491 U

(51) Int. Cl.
*B65D 88/26* (2006.01)
*B65D 88/28* (2006.01)
(Continued)

(52) U.S. Cl.
CPC ..... *B65D 88/28* (2013.01); *B65D 88/64* (2013.01); *B65D 90/024* (2013.01)

(58) Field of Classification Search
CPC ..... B65D 88/26; B65D 88/28; B65D 88/32; B65D 88/54; B65D 88/60; B65D 88/64; B65D 90/024
See application file for complete search history.

(56) References Cited

U.S. PATENT DOCUMENTS 3,124,906 A * 3/1964 Fegles ..... B65D 88/32 222/129
3,207,330 A * 9/1965 Charyn ..... B28C 7/0061 414/268

(Continued)

FOREIGN PATENT DOCUMENTS

DE 1226942 B 10/1966
DE 1269955 B 6/1968

(Continued)

*Primary Examiner* — Gisele D Ford
(74) *Attorney, Agent, or Firm* — James Creighton Wray; Meera P. Narasimhan

(57) ABSTRACT

The present invention relates to a silo (1) comprising one or more cells (2), each cell comprising one or more outlet openings (3), wherein said cells have an angular cross-section and wherein said outlet openings have a non-angular cross-section, wherein said outlet openings and said cells are connected to one another by means of a transition plate (4), wherein the angle a between the wall of the cell and said transition plate is constant along the radial periphery of the outlet opening. The present invention also relates to a kit and a method for constructing such silo.

20 Claims, 6 Drawing Sheets

(51) Int. Cl.
*B65D 88/64* (2006.01)
*B65D 90/02* (2006.01)

(56) References Cited

U.S. PATENT DOCUMENTS 3,382,633 A * 5/1968 Wilson ..... B65D 88/32 220/565
3,871,148 A * 3/1975 Watson ..... B65D 88/32 414/268
4,218,859 A * 8/1980 Sams ..... B65D 90/08 52/194
4,361,254 A 11/1982 Teraoku
7,392,624 B2 * 7/2008 Kinzer ..... B65D 88/022 52/192
8,083,083 B1 * 12/2011 Mohns ..... B65D 88/32 220/1.5
2003/0019538 A1 * 1/2003 Sridhar ..... B63B 35/44 141/104
2006/0118504 A1 * 6/2006 Willemsen ..... B08B 9/093 211/189
2007/0187432 A1 * 8/2007 Snowdon ..... B65D 88/128 222/251
2007/0210080 A1 * 9/2007 Hooper ..... B65D 88/121 220/1.5
2010/0308063 A1 * 12/2010 Pu ..... B60P 3/2205 220/669
2011/0127178 A1 * 6/2011 Claussen ..... B65D 88/26 206/216
2011/0284027 A1 * 11/2011 Logan ..... B08B 9/08 134/10
2015/0175348 A1 * 6/2015 Southwell ..... B65D 90/587 222/1

FOREIGN PATENT DOCUMENTS

FR 2091849 A1 1/1971
FR 2541715 A1 8/1984
GB 1230863 A 5/1971
WO 9322225 A1 11/1993

* cited by examiner

SILO, KIT AND METHOD FOR CONSTRUCTING A SILO

This application claims the benefit of Belgian Application No. BE2014/0783 filed Oct. 23, 2014, German Application DE202015101491.0 filed Mar. 24, 2015 and PCT/IB2015/058194 filed Oct. 23, 2015, International Publication No. WO 2016/063259 A1, which are hereby incorporated by reference in their entirety as if fully set forth herein.

TECHNICAL FIELD

The present invention relates to silos consisting of a vertically arranged cell and an outlet opening at the bottom, and more specifically silo complexes comprising a plurality of such silos.

In particular, the invention relates to silos in which the cell and the outlet nozzle have a different cross-section, e.g. a rectangular or square cross-section for the cell and a circular or oval-shaped cross-section for the outlet opening.

BACKGROUND

Silos are used industrially for the temporary storage of bulk or dump goods in the form of powders or granular products such as grain, coals, cement, animal feed, sand, gravel, fertilizer, etc. The two most common types of silos have cylindrical or square towers, which function as cell or storage space. At the bottom of the cell, the silo is provided with one or more outlet openings where the stored material can be transferred to a transport system or to a truck for transport.

Such silos are already known according to the state of the art. For example, FR 2 541 715 describes a cylindrical silo with a cell bottom having at least two discharge openings, each of which is located at the bottom of an outlet opening with inclined walls; said outlet openings are separated by at least one upright edge which is straight or bent downward in the vertical plane and is formed by the intersecting line of the walls of said outlet openings, all of these outlet openings are situated in a circle with radius R=4/10 of that of the silo, and at least one additional discharge opening which is also at the bottom of an outlet opening with inclined walls and separated from said large outlet openings at least by an elevated edge which is rectilinear or curved, and wherein said additional outlet openings are located outside of said circle with the discharge openings, and are also separated by upright edges.

A similar concept to that described in FR 2 541 715 is shown in U.S. Pat. No. 4,361,254. U.S. Pat. No. 4,361,254 discloses a hopper having a peripheral side wall having upper and lower outlet openings and a cone-shaped body arranged inside the peripheral side wall, which thus defines an annular space for the storage of solid material there between. The lower outlet opening is separated from the cone-shaped body and thus defines an annular discharge point there between.

Finally, the German patent publication DE 1 226 942 describes a first silo for heavy-flowing bulk material with a prismatic or cylindrical upper part which merges into a prismatic base, the circumference of which is described by the upper part, and which contains a cross-shaped roof.

A major problem with silos is the incomplete outflow of the stored material. Such material can decay or degenerate, as a result of which not only the quality of the stored material may be jeopardised, but also creating a risk of infection for all the material stored in the cell of the silo. However, the prior art does not show any silos in which the necessary measures have been taken to impede or at least partly prevent the accumulation of residual material.

The current state of the art does not provide or does not adequately provides a solution to one or more of the above-mentioned problems or shortcomings.

SUMMARY

To this aim, the invention provides in a first aspect a silo comprising one or more cells, each cell comprising one or more outlet openings, wherein said cells have an angular cross-section and wherein said outlet openings have a non-angular cross-section, wherein said outlet openings and said cells are connected to one another by means of an transition plate, wherein the angle $\alpha$ between the wall of the cell and said transition plate is substantially constant along the radial periphery of the outlet opening.

This offers the advantage that the material stored in the silo experiences a uniform shear along the periphery of the outlet opening. Consequently, no material is left behind, for example in the corners of the cell, as a result of which decay or rotting of organic or biological material could come about.

In a second aspect, the invention provides a kit for the assembly of a silo according to the first aspect of the invention, comprising:

A. one or more wall panels;

B. one or more outlet openings;

C. connecting elements for said wall panels and/or said outlet openings;

D. one or more transition plates, wherein said transition plates, when in the state mounted in the silo, define a substantially constant angle $\alpha$ between the wall of the cell and said transition plate.

In a third aspect, the invention provides a method for constructing a silo according to the first aspect of the invention, comprising the steps of (i) the vertical construction of one or more cells with an angular cross-section; (ii) the positioning of one or more outlet openings underneath said cells; and (iii) the connecting of the walls of said cells with the corresponding outlet openings by means of a transition plate, wherein the angle $\alpha$ between the wall of the cell and said transition plate along the radial periphery of the outlet opening is kept substantially constant.

In a fourth aspect, the invention provides the use of a silo according to the first aspect of the invention for the storage of bulk and/or dump materials, such as preferably a granular solid material.

DESCRIPTION OF THE FIGURES

The explicit characteristics, advantages and objectives of the present invention will further become clear to the skilled person in the technical field of the invention after reading the following detailed description of the embodiment of the invention and of the figures enclosed herein. The figures serve the purpose of further illustrating the invention, without thereby limiting the scope of the invention.

FIGS. 1 and 2 represent a simplified representation of a silo according to the first aspect of the present invention.

DETAILED DESCRIPTION OF THE INVENTION

Figure 1A:
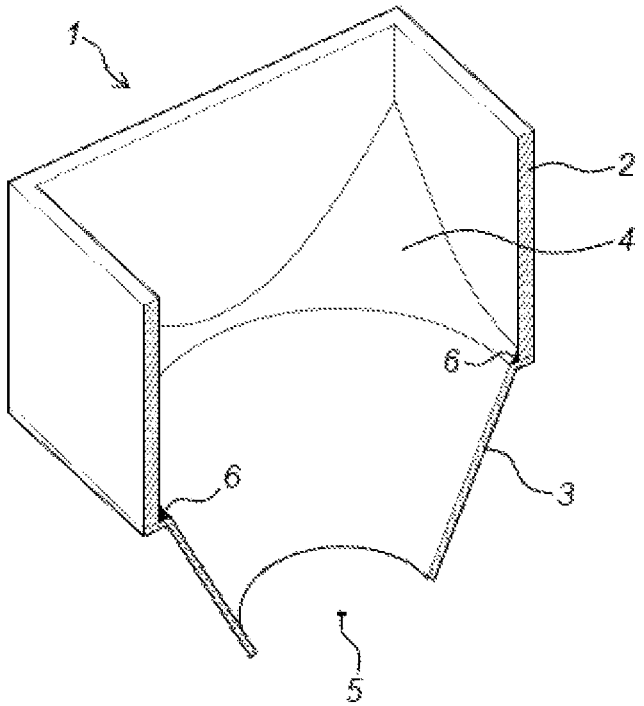
FIGS. 1*a*, 1*b* and 1*c* are schematic representations of a silo 1 with a cell 2 having a square cross-section and a circular outlet opening 3, connected by means of a transition plate 4.

Unless defined otherwise, all terms used in the description of the invention, including technical and scientific terms, have the meaning as they are commonly understood by the skilled person in the technical field of the invention. For a better assessment of the description of the invention, the following terms are explained explicitly.

"A", "an" and "the" refer in this document to both the singular and the plural, unless the context clearly implies otherwise. For example, "a segment" means one or more than one segment.

When "around" or "about" or "substantially" is used in this document with a measurable quantity, a parameter, a time period or moment in time, and the like, then variations are meant of +/−20% or less, preferably +/−10% or less, more preferably +/−5% or less, even more preferably +/−10% or less, and even more preferably +/−0.1% or less than and of the cited value, to the extent that such variations apply in the described invention. It should, however, be understood that the value of the quantity in which the term "around" or "about" or "substantially" is used, is itself specifically disclosed.

The terms "comprise", "comprising", "consist of", "consisting of", "provided with", "include" "including", "contain", "containing", "encompass", "encompassing" are synonyms and are inclusive or open terms that indicate the presence of what follows, and which do not exclude or prevent the presence of other components, features, elements, members, steps, known from or described in the prior art.

Quoting numerical intervals by endpoints comprises all integers, fractions and/or real numbers between the endpoints, these endpoints included.

The term "silo" refers to a storage volume comprising one or more silo blocks, each silo block comprising one or more cells or silo cells, each cell suitable for the storage of a dump or bulk material. Such cells are generally arranged vertically, whereby each cell is provided with at least one outlet opening. In a broad sense, the term "silo" should be understood in the context of the present invention as a silo complex comprising a plurality of cells and/or a plurality of outlet openings.

The term "cell", in the context of the present invention, should be understood as a synonym for the terms "silo cell", "container", "tank", "reservoir", "barrel", "repository", "holder", "cistern", and refers to a volume formed by one or more walls for the storage of bulk or dump material. At the upper side, said cell may be sealed by means of a covering or roof; at the bottom side, said cell is partly or completely open, and merges into one or more outlet openings.

The term "outlet opening" is to be understood as a synonym for the terms "opening", "outlet", "orifice", "mouth", "aperture", and is to be understood as an opening along which the bulk or dump material can leave the silo to thus be transferred on a conveyor belt or in a loading wagon for transport.

The term "transition plate" is to be understood as a synonym for the terms "intermediate plate", "intermediate element" or "transition element", and indicates a plate which is located between the inner walls of the cell and the outlet opening, and which is connected at least partially and preferably completely to the inner walls of the cell and the outlet opening. Said transition plate may be completely or partially curved, and may be formed by one or more segments, which may be referred to as "partial plates" or "angle plates".

In a first aspect, the invention provides a silo comprising one or more cells, each cell comprising one or more outlet openings, wherein said cells have an angular cross-section and wherein said outlet openings have a non-angular cross-section, wherein said outlet openings and said cells are connected to one another by means of an transition plate, wherein the angle $\alpha$ between the wall of the cell and said transition plate is substantially constant along the radial periphery of the outlet opening.

The term "substantially constant" is to be understood as a synonym for "mainly constant" or "roughly constant" and is preferably understood as "constant". The term "substantially constant" is to be understood as +/−20% or less, preferably +/−10% or less, more preferably +/−5% or less, even more preferably +/−1% or less than and of the average value of the angle $\alpha$ between the wall of the cell and said transition plate. By this is meant that the angle $\alpha$ between the wall of the cell and said transition plate varies within the limits of the average value of angle $\alpha$, $|\alpha|$, +/−20% or less, or in short: $|\alpha|$+/−20% or less. Preferably, angle $\alpha$ varies within the limits of $|\alpha|$+/−10% or less, more preferably $|\alpha|$+/−5% or less, and most preferably $|\alpha|$+/−1% or less.

This offers the advantage that the material stored in the silo experiences a uniform shear along the periphery of the outlet opening. As a result, no material is left behind, for example in the corners of the cell, as a result of which decay or rotting of organic or biological material could come about. Such degeneration is to be prevented in order to guarantee the quality of the stored material.

In this way, the angle of inclination $\alpha$ between the transition plates and the vertical wall is constant along the entire circumference of the outlet opening. Because the angle of inclination $\alpha$ is constant, a better outflow is ensured. At a varying angle of inclination $\alpha$, the pressure in the material to be stocked, e.g. flour, will also vary along the circumference of the outlet opening. This varying pressure will eventually lead to a more difficult outflow or even blockage of material in the zones with higher pressure. Blockage of residual materials, such as e.g. flour, may lead to fungi formation and decay—which is particularly to be avoided.

In a preferred embodiment, the present invention provides a silo according to the first aspect of the invention, wherein said outlet opening is completely situated within the periphery of the cell walls. As a result, the outlet opening can be completely suspended within the container volume and attached along the entire periphery of the outlet opening, preferably by means of welding seams, to the inner walls of the container volume via the transition plates. This offers the advantage that no additional reinforcements or supports are required, making the construction simpler.

In a preferred embodiment, the present invention provides a silo according to the first aspect of the invention, wherein the angle of inclination β between said transition plate and the horizontal is greater than 30°, preferably greater than 40°.

The term "horizontal" is to be understood in this context as perpendicular to the longitudinal direction of the silo and preferably perpendicular to the direction of the force of gravity. In a more preferred embodiment, said gradient β is greater than 50° and more preferably greater than 60°. More preferably, said gradient is comprised between 65° and 85°, and most preferably said gradient is equal to 66°, 68°, 70°, 72°, 74°, 76°, 78°, 80°, 82°, or 84°, or any value therein between. This offers the advantage that a good shear of the stored bulk or dump material can be obtained, reducing the risk of residual material is reduced. The skilled person will appreciate that the optimum gradient is partly dictated by the nature of the bulk or dump material, and will be able to determine the optimum gradient according to the storage material.

In a preferred embodiment, the present invention provides a silo according to the first aspect of the invention, wherein said transition plate is comprised of two or multiple partial plates which are, when arranged adjacent next to each other, connectable to the inner walls of said cells at the upper edge and are connectable to said outlet openings at the bottom edge.

The term "partial plate" is to be understood as "segment" or "transition segment", and indicates a plate which in appropriate combination with the corresponding partial plate or partial plates, forms one whole corresponding to said intermediate plate or transition plate.

This offers the advantage that said partial plates can easily be mounted in said silo at the level of the transition from the cell to the outlet opening. In addition, such partial plates can be transported more easily to the location of the silo to be constructed. Such partial plates can also be produced more easily by means of bending a substantially triangular plate over an inflection point.

In a preferred embodiment, the present invention provides a silo according to the first aspect of the invention, wherein said one or more cells have a rectangular cross-section, preferably a square cross-section.

This offers the advantage that these silos can easily be built by means of the connecting of the corresponding ends of the wall panels, which ends are provided with suitable connection elements for the connection of two or more wall panels to one another, so that the walls of the cell are formed. Moreover, cells with a rectangular cross-section offer the advantage that multiple silo cells optimally fit to one another in a silo complex. Thus, the volume for storage of bulk or dump material is used optimally.

In a preferred embodiment, the present invention provides a silo according to the first aspect of the invention, wherein said one or more outlet openings have a round cross-section, preferably a circular cross-section.

Figure 1B:
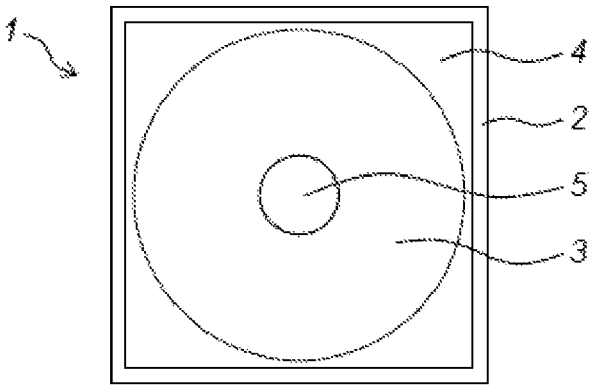
Figure 1C:
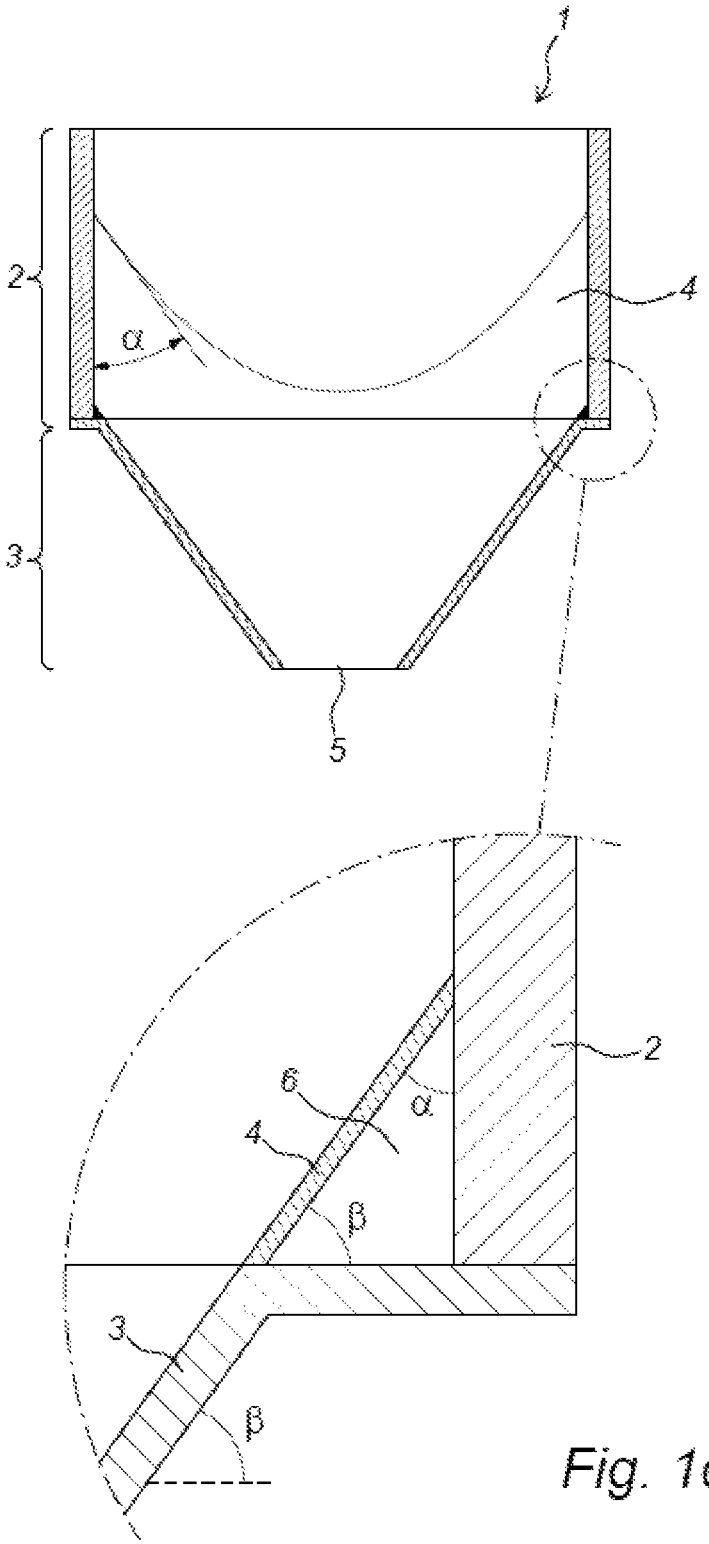

FIG. 1 is a schematic representation of a silo 1 with a cell 2 with square cross-section and circular outlet opening 3, connected by means of an transition plate 4. FIG. 1*a* shows in perspective view a schematic representation of a vertical cross-section of such a silo 1. The transition plate 4 connects the inner walls of the cell 2 with the edges of the outlet opening 3. At the bottom, the outlet opening 3 is provided with a circular opening 5. FIG. 1*b* shows a top view of a horizontal cross-section. FIG. 1*c* shows a side view of a vertical cross-section with indication of the angle α formed by the walls of the cell and the transition plate, and with a detail drawing of the transition of the cell 2 to the outlet opening 3. The detail cut-out shows the transition plate in further detail, wherein also the angle α and the angle of inclination or gradient β are indicated, which defines the gradient of the outlet opening and of the transition plate. Enclosed between the walls of the cell, the outlet opening and the transition plate is the 'dead' volume 6, where the bulk or dump material would accumulate and remain in absence of the transition plate 4.

In an alternative embodiment, said cell has a rectangular horizontal cross-section with a well-defined length and width and the horizontal cross-section of the outflow opening is oval-shaped.

Figure 2A:
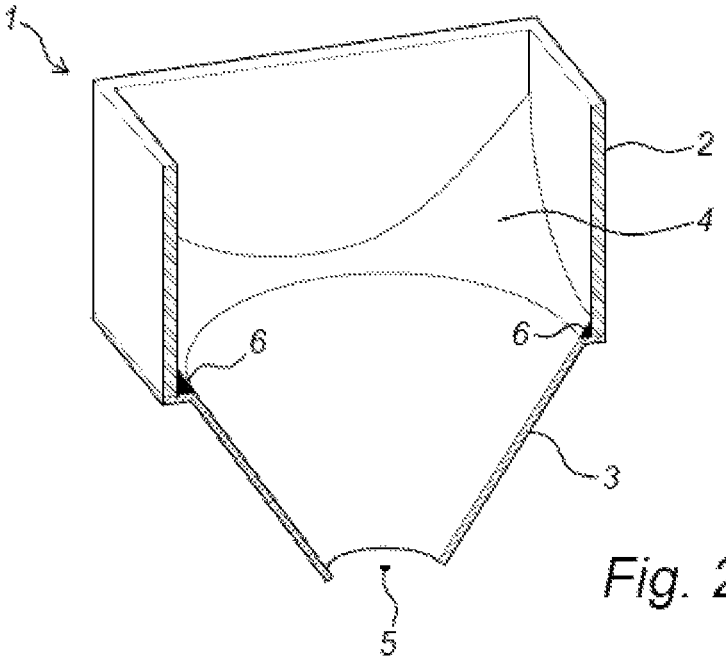
FIGS. 2*a*, 2*b* and 2*c* are schematic representations of a silo 1 with a cell 2 having a rectangular cross-section and oval-shaped outlet opening 3, connected by means of a transition plate 4.
Figure 2B:
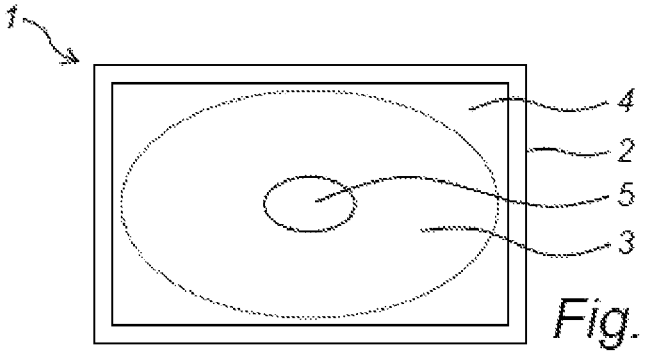
Figure 2C:
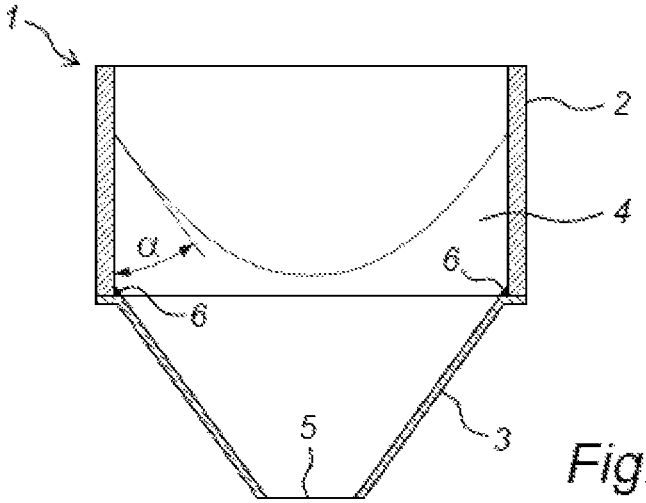

FIG. 2 is a schematic representation of a silo 1 with a cell 2 having a rectangular cross-section and oval-shaped outlet opening 3 and outlet opening 5, wherein the walls of the cell 2 with said outlet opening 3 are connected by means of an transition plate 4.

In a preferred embodiment, the present invention provides a silo according to the first aspect of the invention, wherein said cell is quadrangular and wherein said transition plate comprises four partial plates for covering the corresponding four base angles of said cell.

This offers the advantage that the four partial plates can easily be manufactured with known design techniques; that said partial plates can easily be transported; and that said partial plates can easily be assembled and attached to the silo.

Figure 3:
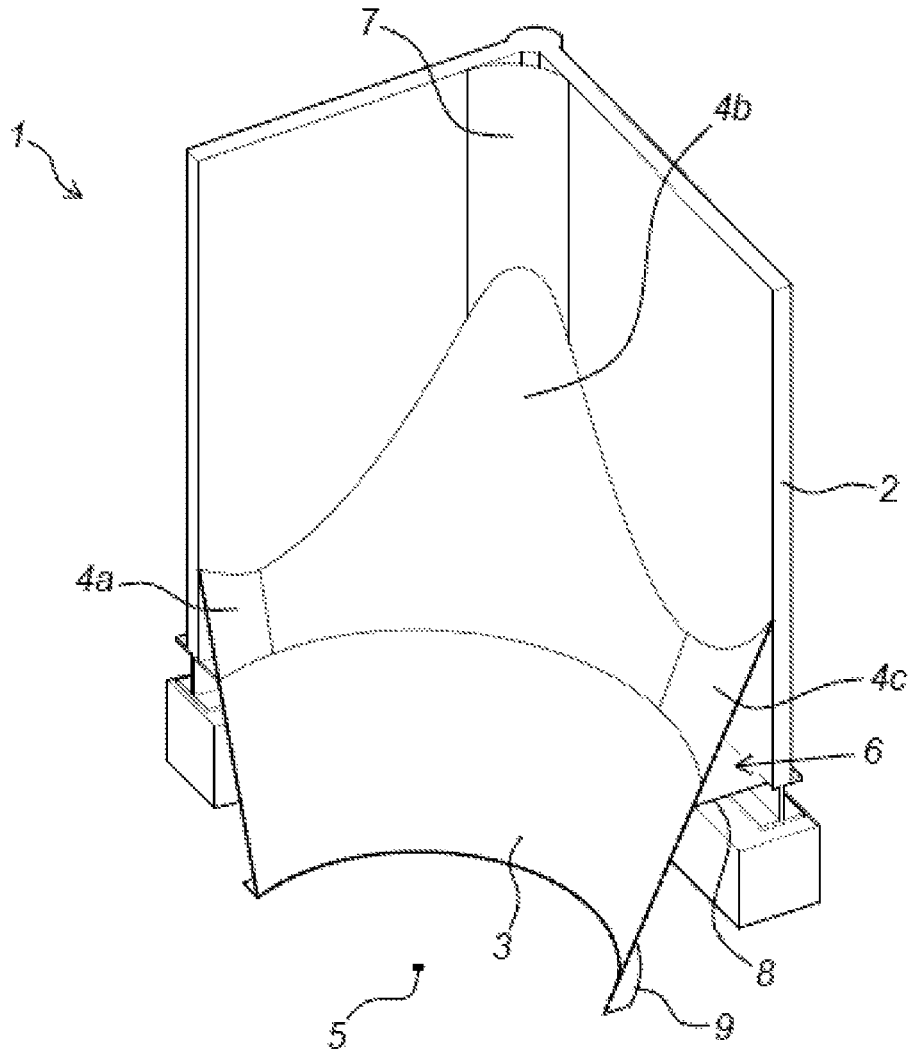
FIG. 3 is a schematic representation of an internal perspective view of a corner cross-section of a cell 2 of a silo 1 with circular outlet opening 3.

FIG. 3 is a schematic representation of an internal perspective view of a corner cross-section of a cell 2 of a silo 1 with circular outlet opening 3. The figure shows an angle plate as specific embodiment for the above-mentioned partial plate. One angle plate 4*b* is shown in the corner and is flanked by two partially shown angle plates, 4*a* and 4*c*. This angle plates 4 form a connection between the walls of the cell 2 and cover the 'dead volume' behind the angle plates 4. In the vertical direction, also referred to as longitudinal direction, of cell 2, the angle can be further covered by a longitudinal angle plate 7 which represents a mainly rectangular plate which is curved in the longitudinal direction. Accordingly, the longitudinal angle plate 7 is provided in a concavely rounded embodiment in order to connect to the angle plate 4. At the bottom of the outlet opening 3, the periphery can connect to an edge 9. This longitudinal angle plates 7 ensure just like the transition plates 4 for a better outflow of stored material, e.g. flour, because there are fewer irregularities in the corners of the wall. With irregularities, there is a threat of accumulation of material, such as e.g. flour, and therefore also decay.

Figure 4:
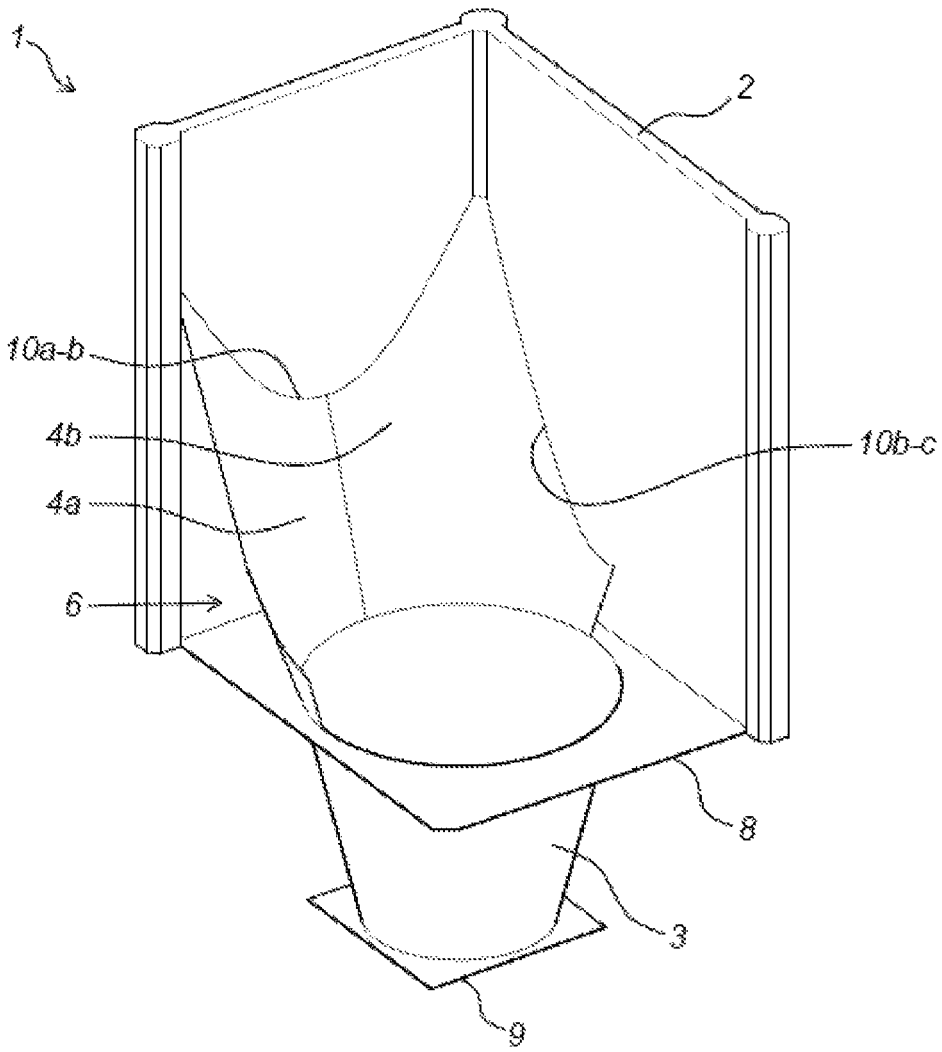
FIG. 4 is a schematic representation of an exploded perspective view of a cell 2 of a silo 1.

FIG. 4 is also a schematic representation of an exploded perspective view of a cell 2 of a silo 1. In FIG. 4, only two walls of the cell 2 are shown. The outlet opening 3 comprises a cone with circular cross-section and open base and top. As shown in the figure, the top has a wider cross-section compared to the base. Along the periphery of the open top, the cone connects to a rectangular, or more specifically square-shaped, flat plate 8 which at the bottom in the cell is suspended and fixed. At the open base, the outlet opening 3 may also connect to a flat, rectangular plate 9. The angle plates 4*a* and 4*b* are provided in the respective corners of the cell 2 and form a contact line 10*a-b* and 10*b-c* between the walls of the cell 2 and the angle plates 4. The contact lines in FIG. 4 show that the contact lines on each wall do not necessarily have the same geometry. In the corners between the walls the angle plates 4 connect to the geometry of the corner elements which fix the walls with respect to one another.

In a preferred embodiment, the present invention provides a silo according to the first aspect of the invention, wherein said partial plates can be obtained by a central point bend of a substantially triangular plate to the desired curvature, corresponding to the desired gradient β and the desired angle α between the wall of the cell and said transition plate.

In the context of the present invention, it is assumed that the skilled person is familiar with design techniques relating to the bending of plates, such as, for example, metallic plates and more preferably steel plates. Thus, the skilled person can, by means of calculation methods known in the prior art, calculate the necessary bending angles for obtaining a partial plate with the desired angle α and the desired gradient β.

The term "mainly triangular" is to be understood as a triangular element in which the two base angles are cut off in such a way so that the obtained partial plates can connect along a common vertical cut. Optionally, the apex angle can be cut off as well. It is further indicated that the width of the cut-off of base angles is less than 10% of the total length of the base side of the triangle, and preferably less than 5%. The width of the cut-off of the apex angle is preferably less than 5% of the total length of the base side of the triangular element.

In a preferred embodiment, the present invention provides a silo according to the first aspect of the invention, wherein said one or more outlet openings are provided in the form of a truncated cone with an open base and top, wherein the periphery of said top is connected to said transition plate, and wherein the diameter of said top is greater than the diameter of said base. This offers the advantage that a funnel-shaped element is provided for centralizing the outflow of the bulk or dump material. In an alternative embodiment, said base surface is provided in an angular, e.g. rectangular or square, or in a non-angular, e.g. oval, shape. Connected to the periphery of said base, along at least a part of the periphery, an additional cover may further be provided which may differ in diameter from the diameter of said base, and wherein said diameter may be larger than the diameter of said base. In this specific context, the term "diameter" should be understood as the distance between two points located farthest from one another along a periphery, be it an angular or a non-angular periphery.

In a preferred embodiment, the present invention provides a silo according to the first aspect of the invention, wherein said transition plate is attached to the inner walls of said one or more cells by means of a weld seam. Even more preferably, said welds are flattened, and even more preferably polished, at the inner wall of the container in order to thus not cause any irregularities on the inner surface of the container wall. Such irregularities possibly cause an accumulation of stored material and thus cause a hampered outflow of stored material. Such blockage or accumulation could therefore lead to fungi formation or decay.

In a preferred embodiment, said transition plate is adhered to the inner walls of said one or more cells with the aid of a binding agent. In an alternative embodiment, said transition plate is connected to the inner walls of said one or more cells with the aid of mechanical binding agents, such as, for example, bolts and nuts.

Figure 5:
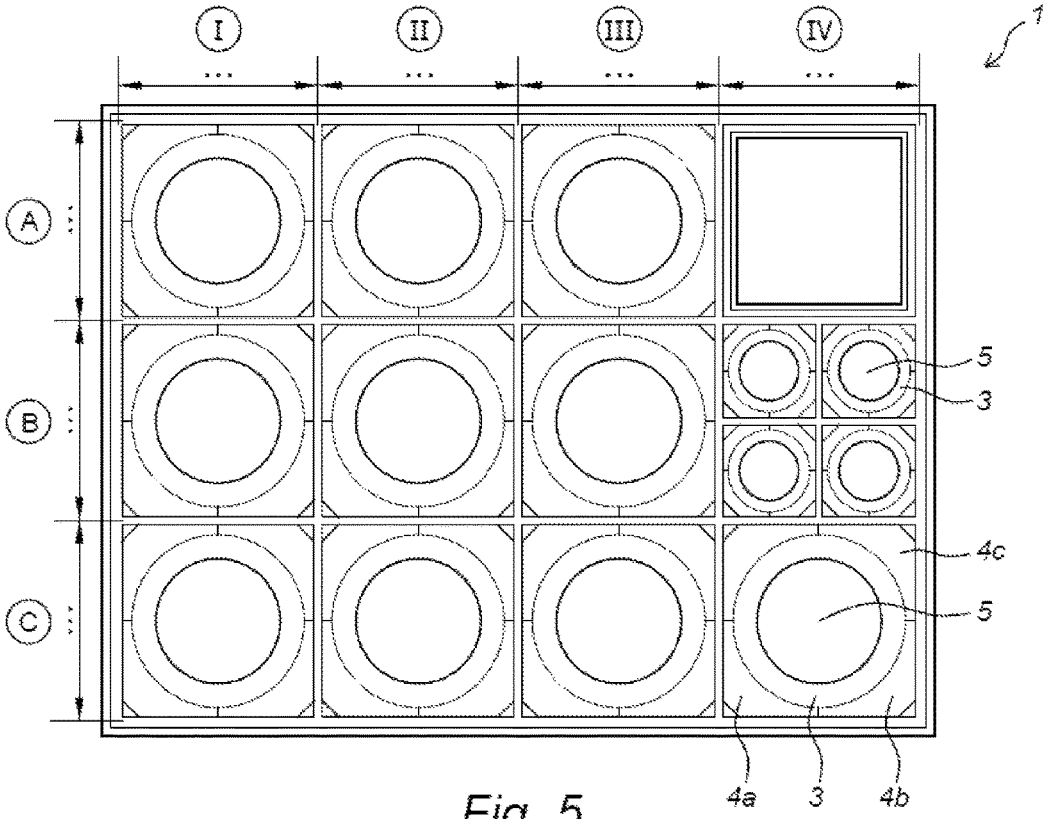
FIG. 5 is a schematic representation of a silo 1 with a plurality of cells 2 arranged in rows (A, B, C) and columns (I, II, III, IV).

FIG. 5 is a schematic representation of a silo 1 with multiple cells 2 arranged in rows (A, B, C) and columns (I, II, III, IV). The figure is a schematic top view of a cross-section of a silo 1 with multiple cells and shows that multiple configurations are possible. Specifically, a configuration is shown in FIG. 5, wherein ten cells with similar geometry are shown, one cell (cell B-IV) which itself is divided into four cells and one non-filled cell (cell A-IV). The cells can further be provided with similar or different heights.

In a second aspect, the invention provides a kit for the assembly of a silo according to the first aspect of the invention, comprising:

A. one or more wall panels;

B. one or more outlet openings;

C. connecting elements for said wall panels and/or said outlet openings;

D. one or more transition plates, wherein said transition plates, when in the state mounted in the silo, define a substantially constant angle α between the wall of the cell and said transition plate.

This offers the advantage that the silo to be assembled can easily be transported as a package to the desired location.

In a preferred embodiment, said wall panels are flat at the top and bottom side, so that these connect with a wall panel lying underneath or above. The ends of the wall panels are preferably provided with connection elements for connecting the wall panels to adjacent wall panels in a corner and/or in line with each other. Optionally, said kit also comprises one or more connecting members for the sealing of the connection along a side where there is no connection with a wall panel. In this way, for example, two connecting elements need to be added for every two wall panels which form a corner which does not connect with a next silo cell; and a connecting element needs to be added for every three wall panels which form a wall with an inner partitioning wall.

In a preferred embodiment, the present invention provides a kit according to the second aspect of the invention, wherein said one or more transition plates are comprised as a kit of, preferably four, partial plates which can be connected with one another and wherein each partial plate can be obtained by a central point bend of a substantially triangular plate to the desired curvature, corresponding to the desired gradient β and the desired angle α between the wall of the cell and said transition plate.

In a third aspect, the invention provides a method for the construction of a silo according to the first aspect of the invention, comprising the steps of (i) the vertical construction of one or more cells with an angular cross-section; (ii) the positioning of one or more outlet openings underneath said cells; and (iii) the connection of the walls of said cells with the corresponding outlet openings by means of a transition plate, wherein the angle α between the wall of the cell and said transition plate along the radial periphery of the outlet opening is kept substantially constant.

In a preferred embodiment, the present invention provides a method according to the third aspect of the invention, wherein said transition plate is formed out of four partial plates which are manufactured out of a substantially triangular plate which is curved by means of a central point bend to the desired gradient β.

In a preferred embodiment, the present invention provides a method according to the third aspect of the invention, wherein said partial plates are arranged adjacent next to one another, in adjacent connection with the inner walls of said cell, and subsequently are connected by means of a weld seam to the inner walls of said cell. Subsequently, said transition plate can also be connected by means of a weld seam to the one or more outlet openings. In this way, the outlet openings are suspended from the transition plate or transition plates. In an also preferred embodiment, said transition plate is glued to the inner walls of said one or more cells with the aid of a binding agent. In an alternative embodiment, said transition plate is connected to the inner walls of said one or more cells by means of mechanical binding agents, such as, for example, bolts and nuts.

In a fourth aspect, the invention provides the use of a silo according to the first aspect of the invention for the storage of bulk and/or dump materials, such as, preferably granular solid material, and more preferably fine-particle material. More preferably, the invention provides the use of a silo according to the first aspect of the invention for the storage of perishable materials, and even more preferably fine-grained, perishable materials. Non-limiting examples of such materials are plastic pellets and materials from biological origin, such as, for example, wood pellets, food products, flour, etc.

This has the advantage that the materials can be stored and dispensed, without material remaining thereby in the dead volumes of the cell with the outflow of material from the cell. Such a stoppage might lead to decay and/or fungi formation of the stored material.

The invention claimed is:

1. A silo (1) comprising one or more cells (2), each cell (2) comprising a plurality of walls defining a perimeter and an outlet opening (3), wherein said one or more cell (2) has an angular cross-section and said outlet opening (3) has a non-angular cross-section, wherein said outlet opening (3) and a corresponding wall of said one or more cells (2) are connected by means of a curved transition plate (4) having upper and lower edges, the curved transition plate having a curvature along the upper edge between an uppermost point disposed between two adjacent walls of said cell and a lowermost point disposed along one of said two adjacent walls, wherein an angle $\alpha$ between the cell perimeter and the upper edge of said curved transition plate is constant.

2. A silo (1) according to claim 1, wherein a gradient $\beta$ of said curved transition plate (4) is greater than 30°.

3. A silo (1) according to claim 1, wherein said curved transition plate (4) is comprised of two or more partial plates having upper edges and lower edges which, when arranged adjacent next to each other, are arranged to connect with the two adjacent walls of said cell (2) at the upper edges, and are arranged to connect with said outlet opening (3) at the lower edges.

4. A silo (1) according to claim 1, wherein said one or more cells (2) have a rectangular cross-section.

5. A silo (1) according to claim 1, wherein said outlet opening (3) has a circular cross-section.

6. A silo (1) according to claim 1, wherein said one or more cell (2) is quadrangular and has four base angles and wherein said curved transition plate (4) comprises four partial curved plates for covering the four base angles of said cell.

7. A silo (1) according to claim 3, wherein said partial plates can be obtained by a central point bend of a substantially triangular plate to a desired curvature, corresponding to a desired gradient $\beta$ and a desired angle $\alpha$ between the wall of the cell (2) and said curved transition plate (4).

8. A silo (1) according to claim 1, wherein said one or more outlet openings (3) are provided in the form of a truncated cone with open base and top, wherein a periphery of said top is connected to said curved transition plate (4), and wherein a diameter of said top is greater than a diameter of said base.

9. A silo (1) according to claim 1, wherein said curved transition plate (4) is attached to the two adjacent walls of said one or more cells (2) by means of a weld seam.

10. Use of a silo (1) according to claim 1 for the storage of bulk or dump materials.

11. Use of a silo (1) according to claim 1 for the storage of granular solid or fine grained materials.

12. A silo (1) according to claim 1, wherein a gradient $\beta$ of said curved transition plate (4) is greater than 40°.

13. A silo (1) according to claim 1, wherein said one or more cells (2) has a square cross-section.

14. A silo (1) according to claim 1, wherein said outlet opening (3) has a round cross-section.

15. A kit for the assembly of a silo (1), the kit comprising:

A. a plurality of wall panels;

B. one or more outlet openings (3);

C. connecting elements for said wall panels and said outlet openings (3);

D. one or more curved transition plates (4), wherein said one or more curved transition plates, when mounted in a silo (1), defines a constant angle a between a cell perimeter and an upper edge of said one or more curved transition plate (4), and wherein the curved transition plate has a curvature along the upper edge between an uppermost point disposed between two adjacent walls of a cell and a lowermost point disposed along one of said two adjacent walls.

16. The kit according to claim 15, wherein said one or more curved transition plates are comprised as a kit of partial curved plates which can be connected with each other, and wherein each partial curved plate can be obtained by bending a substantially triangular plate over an inflection point to the desired curvature, corresponding to a desired gradient $\beta$ and a desired angle $\alpha$ between the wall of the cell (2) and said curved transition plate (4).

17. A kit according to claim 15, wherein said one or more curved transition plates are comprised as a kit of four partial plates which can be connected with each other, and wherein each partial plate can be obtained by bending a substantially triangular plate over an inflection point to a desired curvature, corresponding to a desired gradient $\beta$ and a desired angle $\alpha$ between the wall of the cell (2) and said one or more curved transition plate (4).

18. The method for the construction of a silo (1), comprising the steps of (i) the vertical construction of one or more cells (2) having an angular cross-section; (ii) positioning of one or more outlet openings (3) underneath the one or more cells (2); and (iii) connecting walls of said cells (2) to the one or more outlet openings (3) by means of a curved transition plate (4), providing a curvature along an upper edge of the curved transition plate between an uppermost point disposed between two adjacent walls of said cells and a lowermost point disposed along one or another of said two adjacent walls, wherein an angle $\alpha$ between a perimeter of said one or more cells (2) defined by the cell walls and the upper edge of said curved transition plate (4) is constant.

19. A method according to claim 18, wherein said curved transition plate (4) is formed out of four partial plates which are manufactured from a substantially triangular plate which is curved to a desired gradient $\beta$ by bending over an inflection point.

20. The method according to claim 19, wherein said partial plates are arranged adjacent to one another, in adjacent connection with the two adjacent walls of said cell, and subsequently are connected to the two adjacent walls of said cell (2) by means of a weld seam.

* * * * *